US012370401B2

(12) United States Patent
Liu et al.

(10) Patent No.: US 12,370,401 B2
(45) Date of Patent: Jul. 29, 2025

(54) FOLDING MECHANISM FOR ARMREST HANDLE OF TREADMILL

(71) Applicant: Shenzhen Yile Dynamic Technology Co., LTD, Guangdong (CN)

(72) Inventors: Ren Liu, Guangdong (CN); Jinsong Fan, Guangdong (CN)

(73) Assignee: Shenzhen Yile Dynamic Technology Co., LTD, Shenzhen (CN)

( * ) Notice: Subject to any disclaimer, the term of this patent is extended or adjusted under 35 U.S.C. 154(b) by 117 days.

(21) Appl. No.: 18/454,453

(22) Filed: Aug. 23, 2023

(65) Prior Publication Data

US 2025/0041655 A1 Feb. 6, 2025

(51) Int. Cl.
*A63B 21/00* (2006.01)
*A63B 22/02* (2006.01)

(52) U.S. Cl.
CPC ..... *A63B 21/4035* (2015.10); *A63B 22/02* (2013.01); *A63B 2210/50* (2013.01)

(58) Field of Classification Search
CPC . A63B 21/4035; A63B 22/0046; A63B 22/02; A63B 69/0057; A63B 71/0036; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 7,540,829 | B1 * | 6/2009 | Chen | A63B 22/0235 482/54 |
| 7,637,850 | B2 * | 12/2009 | Chen | A63B 22/02 482/54 |
| 7,942,788 | B2 | 5/2011 | Wu | |
| 11,439,864 | B2 | 9/2022 | Tseng | |
| 11,607,598 | B2 * | 3/2023 | Luo | A63B 71/0036 |
| 2004/0198558 | A1 | 10/2004 | Chang | |
| 2009/0280964 | A1 * | 11/2009 | Chen | A63B 22/02 482/54 |
| 2021/0402279 | A1 * | 12/2021 | Luo | A63B 22/02 |
| 2023/0136863 | A1 | 5/2023 | Luo et al. | |

FOREIGN PATENT DOCUMENTS

| | | | | |
|---|---|---|---|---|
| CN | 110860063 A | * | 3/2020 | A63B 22/02 |
| CN | 211301913 U | * | 8/2020 | A63B 22/02 |
| CN | 216497270 U | * | 5/2022 | |
| DE | 202022106891 U1 | * | 4/2023 | A63B 22/02 |

* cited by examiner

*Primary Examiner* — Gary D Urbiel Goldner

(57) ABSTRACT

A folding mechanism for an armrest handle of a treadmill is provided, including: the armrest handle having left and right bottom ends that are configured to be connected to the treadmill; a rotational assembly, including: a connecting rod, a limiting member being provided on a left section of the connecting rod, and a diameter of the limiting member being greater than a diameter of the connecting rod; a rotation control plate, an arc-shaped sliding groove being disposed on the rotation control plate, one end of the sliding groove being provided with a limiting hole that is in communication with the sliding groove, a width of the sliding groove being greater than a width of the connecting rod and less than a width of the limiting member, and a diameter of the limiting hole being greater than the diameter of the limiting member.

7 Claims, 7 Drawing Sheets

A

B

FOLDING MECHANISM FOR ARMREST HANDLE OF TREADMILL

FIELD OF TECHNOLOGY

The present invention relates to the field of treadmills, and more particularly, to a folding mechanism for an armrest handle of a treadmill.

BACKGROUND

Treadmills with armrests may enable functions such as placement of mobile phones and water bottles, which brings convenience to users. However, some treadmills have fixedly mounted armrests that cannot be folded and results in inconvenience for storage. In addition, the armrests need to be disengaged before transportation and then mounted again, which is troublesome. Some treadmills with folding armrests require operations at two sides of the armrests for folding, which is cumbersome. For some treadmills without armrests, the addition of folding armrest handles may be complex in structure, and it is inconvenient for ordinary purchasers to mount the armrest handles.

SUMMARY

It is an object of the present invention to provide a folding mechanism for an armrest handle of a treadmill, which enables the armrest handle to be folded through an operation at one side of the treadmill, so as to achieve an easy operation, a simple structure, and convenience in mounting.

In order to achieve the above object, the present invention provides the following technical solution.

A folding mechanism for an armrest handle of a treadmill includes: an armrest handle having left and right bottom ends that are configured to be connected to a treadmill; a rotational assembly, including: a connecting rod, a limiting member being provided on a left section of the connecting rod, and a diameter of the limiting member being greater than a diameter of the connecting rod; a first connecting plate, a first through hole being disposed on the first connecting plate, and a diameter of the first through hole being greater than the diameter of the limiting member; a second connecting plate, a second through hole being disposed on the second connecting plate, and a diameter of the second through hole being greater than the diameter of the connecting rod; and a rotation control plate, an arc-shaped sliding groove being disposed on the rotation control plate, one end of the sliding groove being provided with a limiting hole that is in communication with the sliding groove, a width of the sliding groove being greater than a width of the connecting rod and less than a width of the limiting member, and a diameter of the limiting hole being greater than the diameter of the limiting member; the first connecting plate and the second connecting plate being fixedly connected to medial sides of the left and right bottom ends, separately, of the armrest handle opposite each other; the rotation control plate being fixedly mounted at one side of the first connecting plate, and the limiting hole being mounted opposite to the first through hole; left and right ends of the connecting rod being connected to the left and right bottom ends of the armrest handle, respectively, through the first connecting plate and the second connecting plate; the connecting rod being not capable of sliding along the sliding groove in a case that the limiting member is positioned in the limiting hole; and the connecting rod being capable of sliding along the sliding groove in a case that the limiting member is moved left and out of the limiting hole.

Further, a limiting cap is provided at a lateral side of the second connecting plate, a right end of the connecting rod is fixedly connected to the limiting cap after passing through the second through hole, and a diameter of the limiting cap is greater than the diameter of the second through hole; a support sleeve is provided at a lateral side of the first connecting plate, a third through hole is disposed at one end of the support sleeve, a diameter of the third through hole is greater than the diameter of the limiting member, an abutting ring is provided at the other end of the support sleeve, a fourth through hole, which is in communication with the third through hole, is disposed at a center of the abutting ring, and a diameter of the fourth through hole is greater than the diameter of the connecting rod and less than the diameter of the limiting member; a left end of the connecting rod successively passes through the fourth through hole and the third through hole to be engaged to an eccentric cam handle; the limiting member is positioned in the limiting hole in a case that the eccentric cam handle is rotated to a closed state, and the limiting member is moved out of the limiting hole in a case that the eccentric cam handle is rotated to an open state.

A first spring is provided inside the support sleeve, with one end of the first spring abutting against an inner wall of the abutting ring, and the other end of the first spring abutting against the limiting member.

Further, a support sleeve is further provided at the lateral side of the second connecting plate, the diameter of the limiting cap is less than the diameter of the third through hole, and a second spring is provided inside the support sleeve, with one end of the second spring abutting against an inner wall of the abutting ring, and the other end of the second spring abutting against the limiting cap.

Further, a rotation control plate is further fixedly mounted at a medial side of the second connecting plate, and the limiting hole is mounted opposite to the second through hole; a limiting member is further provided on a right section of the connecting rod; the right limiting member on the connecting rod is positioned in the right limiting hole in the case that the eccentric cam handle is rotated to the closed state, and the right limiting member on the connecting rod is moved out of the right limiting hole in the case that the eccentric cam handle is rotated to the open state.

Further, a first mounting hole is disposed on the first connecting plate, a second mounting hole is disposed on the rotation control plate, and a fastener successively passes through the left bottom end of the armrest handle, the first mounting hole, and the second mounting hole so as to fixedly connect the first connecting plate and the rotation control plate to a left end of the armrest handle.

Further, a third mounting hole is disposed on the second connecting plate, a second mounting hole is disposed on the right rotation control plate, and a fastener successively passes through the third mounting hole, the second mounting hole, and the right bottom end of the armrest handle so as to fixedly connect the second connecting plate and the right rotation control plate to a right end of the armrest handle.

It can be seen from the analysis that the folding mechanism for an armrest handle of a treadmill disclosed herein enables the armrest handle to be folded through an operation at one side of the treadmill, so as to achieve an easy operation, a simple structure, and convenience in mounting.

The technical solution of the present invention reduces the operational difficulty, the replacement time, and the working intensity, as well as costs.

BRIEF DESCRIPTION OF THE DRAWINGS

The accompanying drawings, which constitute a part of this application, are included to provide a further understanding of the present invention. The illustrative embodiments of the present invention, together with the descriptions thereof, serve to explain the present invention and do not constitute undue limitations on the present invention. In the drawings.

DESCRIPTION OF REFERENCE NUMERALS

Figure 1:
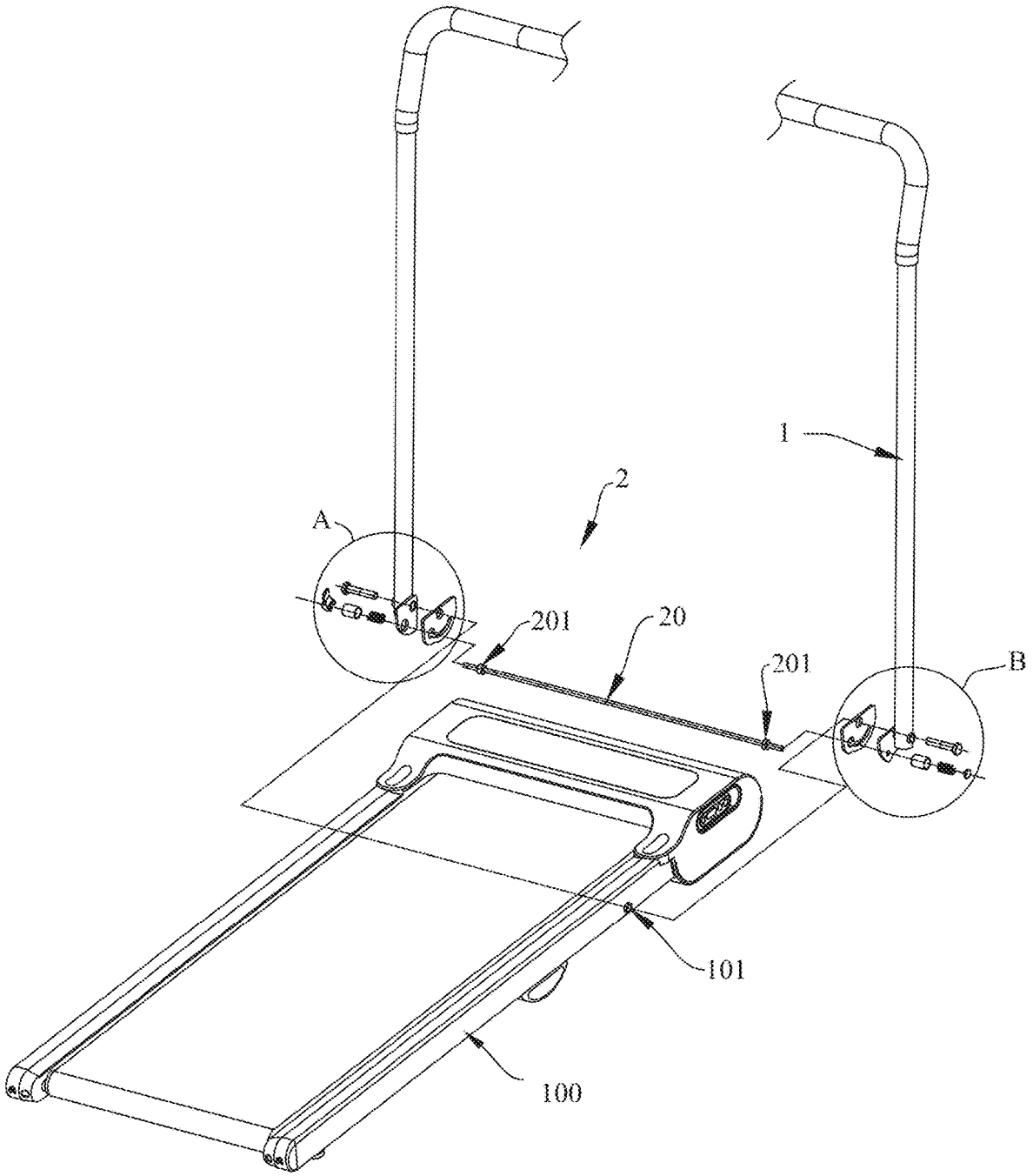
FIG. 1 is an exploded view of an embodiment of a folding mechanism for a treadmill and an armrest handle.
Figure 2:
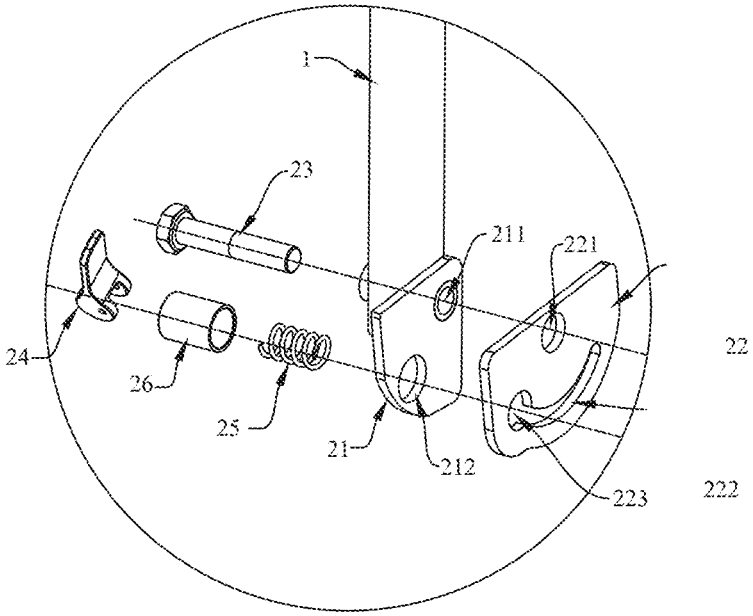
FIG. 2 is an enlarged view of an area circled by a dotted line at A in FIG. 1.
Figure 3:
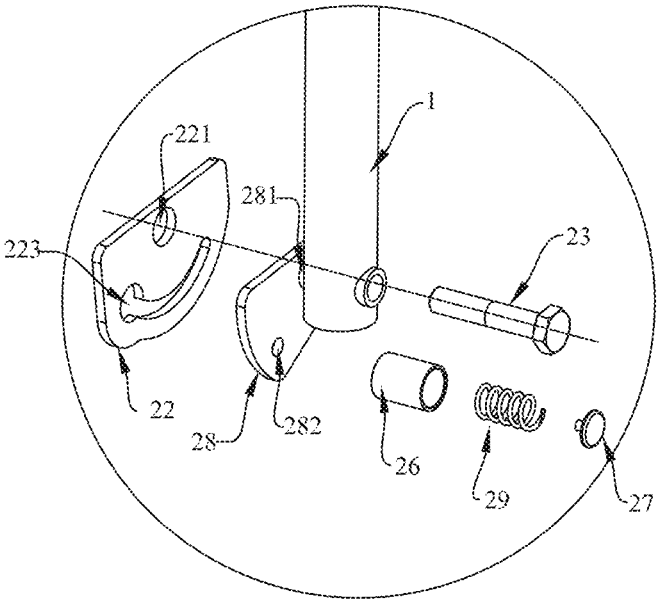
FIG. 3 is an enlarged view of an area circled by a dotted line at B in FIG. 1.
Figure 4:
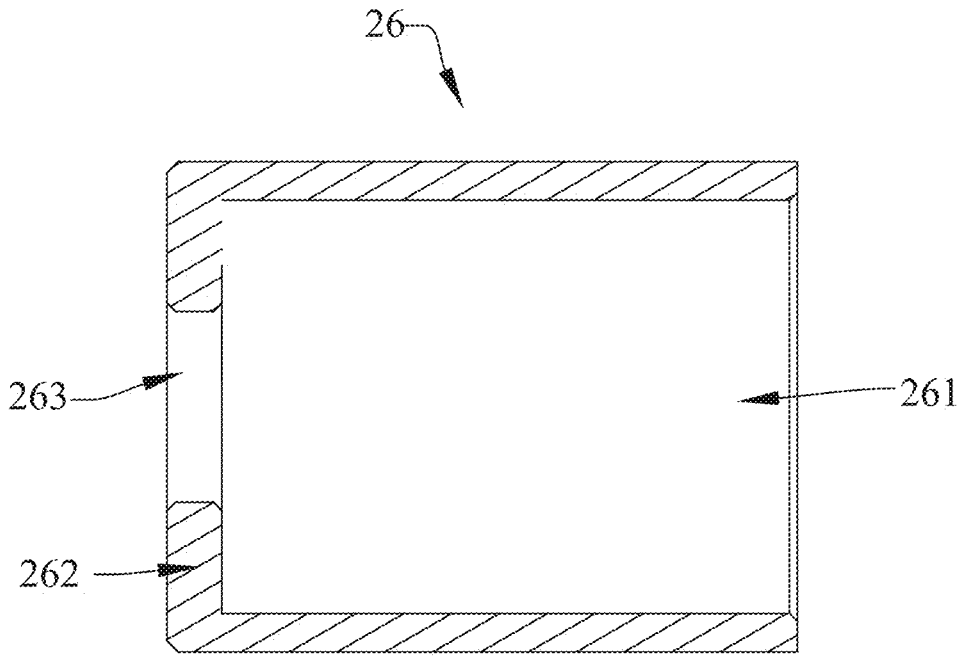
FIG. 4 is a cross-sectional view of a support sleeve in an embodiment of a folding mechanism for an armrest handle.

1—armrest handle; 2—rotational assembly; 20—connecting rod; 201—limiting member; 21—first connecting plate; 211—first mounting hole; 212—first through hole; 22—rotation control plate; 221—second mounting hole; 222—sliding groove; 223—limiting hole; 23—fastener; 24—eccentric cam handle; 25—first spring; 26—support sleeve; 261—third through hole; 262—abutting ring; 263—fourth through hole; 27—limiting cap; 28—second connecting plate; 281—third mounting hole; 282—second through hole; 29—second spring; 100—treadmill frame tube; and 101—fourth mounting hole.

DETAILED DESCRIPTION OF THE EMBODIMENTS

The present invention will be described in detail below with reference to the accompanying drawings and in conjunction with embodiments. The various examples are provided by way of interpretation of the present invention and not limiting the present invention. In practice, it will be apparent to those skilled in the art that modifications and variations may be made in the present invention without departing from the scope or spirit of the present invention. For example, features shown or described as part of one embodiment may be used in another embodiment to produce yet another embodiment. It is therefore desirable that the present invention encompass such modifications and variations falling within the scope of the appended claims and equivalents thereof.

In the description of the present invention, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present invention is to be constructed and operated in a particular orientation and therefore cannot be construed as limiting the present invention. The terms "join", "connect", and "dispose" used in the present invention shall be understood in a broad sense, for example, which may refer to a fixed connection or a detachable connection; which may refer to a direct connection or an indirect connection through intermediate components; which may refer to a wired electrical connection, a wireless electrical connection, or a wireless communication signal connection, and the specific meanings of the above terms may be understood by those of ordinary skill in the art according to a specific situation.

One or more examples of the present invention are shown in the accompanying drawings. The detailed description uses numeric and letter designations to refer to features in the drawings. Similar or like reference signs in the drawings and descriptions have been used to refer to similar or like parts of the present invention. As used herein, the terms such as "first", "second", and "third" are used interchangeably to distinguish one member from another and are not intended to denote the location or importance of any individual member.

As shown in FIGS. 1 to 6, according to an embodiment of the present invention, a folding mechanism for an armrest handle of a treadmill is provided, including an armrest handle 1, two bottom ends of the armrest handle 1 being foldably mounted to a treadmill through a rotational assembly 2. The rotational assembly 2 includes a connecting rod 20, a first connecting plate 21, and a second connecting plate 28. The first connecting plate 21 and the second connecting plate 28 are fixedly mounted at medial sides of the two bottom ends, separately, of the armrest handle 1 opposite each other. A first mounting hole 211 is disposed on the first connecting plate 21 for fixed connection with the armrest handle 1, and a first through hole 212 is further disposed on the first connecting plate 21 for an end of the connecting rod 20 to pass through. A rotation control plate 22 is further provided between the first connecting plate 21 and the connecting rod 20, and a second mounting hole 221 is disposed on the rotation control plate 22. An arc-shaped sliding groove 222 is disposed below the second mounting hole 221 with the second mounting hole 221 as a center. A width of the sliding groove 222 matches with a diameter of the connecting rod 20 such that the connecting rod 20 can pass through the sliding groove 222 and slide within the sliding groove 222. Two ends of the connecting rod 20 are each provided with a column-shaped limiting member 201, and a diameter of the limiting member 201 is greater than the diameter of the connecting rod 20. Besides, the diameter of the limiting member 201 is greater than the width of the sliding groove 222, such that the limiting member 201 cannot pass through the sliding groove 222. Correspondingly, a limiting hole 223 is disposed on the rotation control plate 22 at an end of the sliding groove 222, and the limiting hole 223 is in communication with the sliding groove 222. A diameter of the limiting hole 223 matches with the diameter of the limiting member 201, such that the limiting member 201 can pass through the limiting hole 223. Further, a diameter of the first through hole 212 matches with the diameter of the limiting member 201, such that the limiting member 201 can pass through the first through hole 212. The first connecting plate 21 and the rotation control plate 22 are fixedly connected to an end at one side of the armrest handle 1 via a fastener 23 that successively passes through the bottom end of the armrest handle 1, the first mounting hole 211, and the second mounting hole 221 so as to fix the first connecting plate 21 and the rotation control plate 22 to the armrest handle 1.

A third mounting hole 281 is disposed on the second connecting plate 28 for fixed connection with the armrest handle 1. A second through hole 282 is further disposed on the second connecting plate 28, and a diameter of the second through hole 282 is greater than the diameter of the connecting rod 20 and less than the diameter of the limiting member 201. Likewise, a rotation control plate 22 is provided between the second connecting plate 28 and the connecting rod 20. At an end at the other side of the armrest handle 1, a fastener 23 successively passes through the armrest handle 1, the third mounting hole 281, and the second mounting hole 221 so as to fixedly mount the second connecting plate 28 and the rotation control plate 22 to the end of the armrest handle 1. The left end of the connecting rod 20 successively passes through the limiting hole 223 and the first through hole 212 to be connected to the first connecting plate 21, and the right end of the connecting rod 20 successively passes through the limiting hole 223 and the second through hole 282 to be connected to the second connecting plate 28, thereby realizing the connection between the connecting rod 20 and the armrest handle 1. When the limiting member 201 of the connecting rod 20 is positioned in the limiting hole 223, the connecting rod 20 is in a locked connection with the rotation control plate 22. As such, the connecting rod 20 cannot be moved into the sliding groove 222, and the armrest handle 1 is in a rotation-locked state. When the limiting member 201 of the connecting rod 20 is moved out of the limiting hole 223, the connecting rod 20 is in a limited sliding connection with the rotation control plate 22, the connecting rod 20 can be moved into the sliding groove 222, and as such, the armrest handle 1 is in a rotation-unlocked state.

When mounted, one end of the connecting rod 20 successively passes through the first connecting plate 21 at one side of the armrest handle 1, the rotation control plate 22, the rotation control plate 22 at the other side of the armrest handle 1, and the second connecting plate 28 until the limiting member 201 at an extending end of the connecting rod 20 abuts against the second connecting plate 28.

The two ends of the connecting rod 20 are separately provided with a first spring 25 and a second spring 29. The first spring 25 and the second spring 29 are of the same size and each sheathed within a support sleeve 26. A third through hole 261 with a diameter matching with the diameter of the limiting member 201 is disposed at an end of the support sleeve 26, such that the limiting member 201 can be moved into the support sleeve 26 through the third through hole 261. An abutting ring 262 is provided at the other end of the support sleeve 26 for abutting against the end of the first spring 25 or the second spring 29. A fourth through hole 263 is disposed at a center of the abutting ring 262. A diameter of the fourth through hole 263 matches with the diameter of the connecting rod 20 such that the end of the connecting rod 20 can pass through the fourth through hole 263.

At the side of the armrest handle 1 with the second connecting plate 28, the end of the support sleeve 26 with the abutting ring 262 abuts against the second connecting plate 28. After the connecting rod 20 successively passes through the limiting hole 223, the second through hole 282, the third through hole 261, and the second spring 29, the end of the connecting rod 20 is fixedly connected to a limiting cap 27. A diameter of the limiting cap 27 matches with a diameter of the third through hole 261 of the support sleeve 26 such that the limiting cap 27 can be moved into the support sleeve 26. One end of the second spring 29 abuts against the abutting ring 262, and the other end of the second spring 29 abuts against the limiting cap 27.

Figure 5:
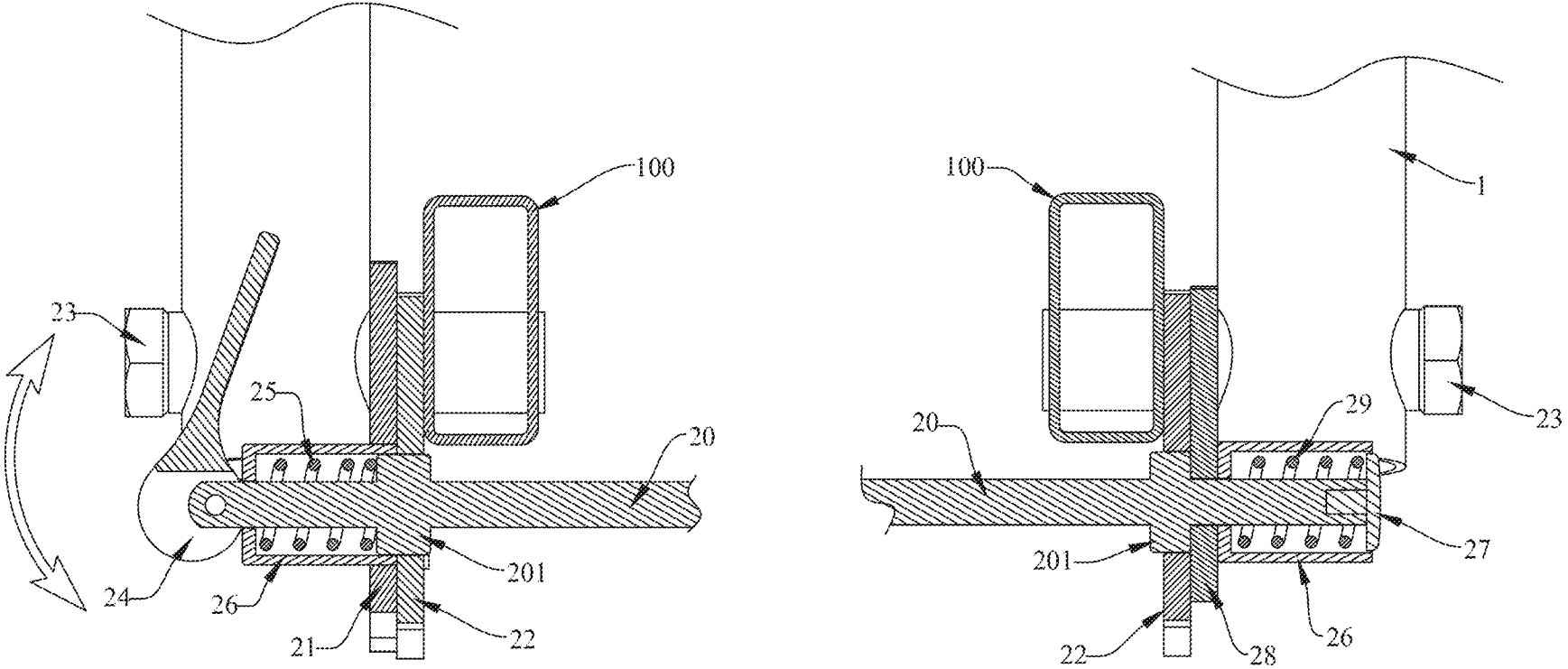
FIG. 5 is a schematic view showing an armrest handle with double-sided locking in use where two sides of the armrest handle are in a locked state in Embodiment 1 of a folding mechanism for an armrest handle.
Figure 6:
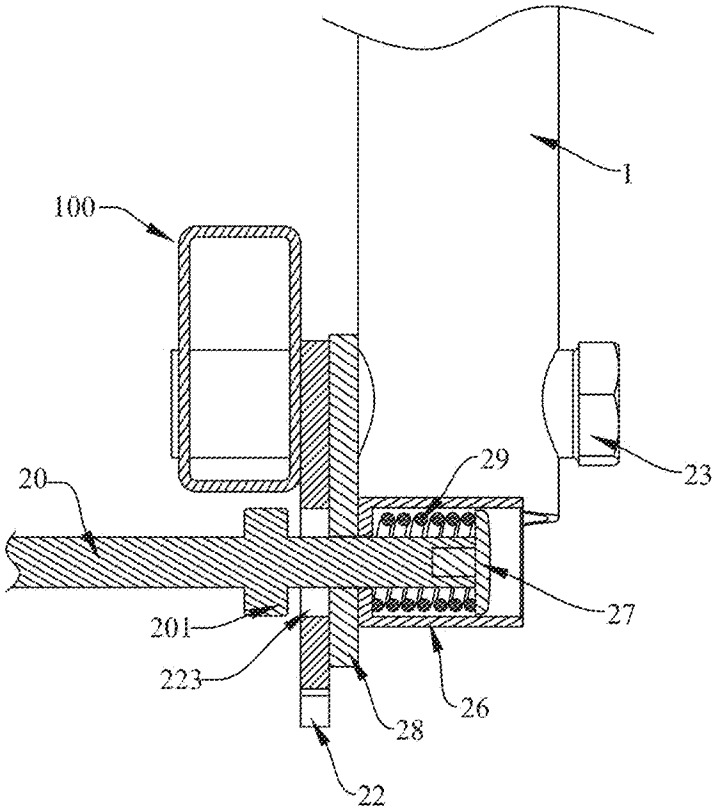
FIG. 6 is a schematic view showing the armrest handle with double-sided locking in use where two sides of the armrest handle are in an unlocked state in Embodiment 1 of a folding mechanism for an armrest handle.
Figure 6:
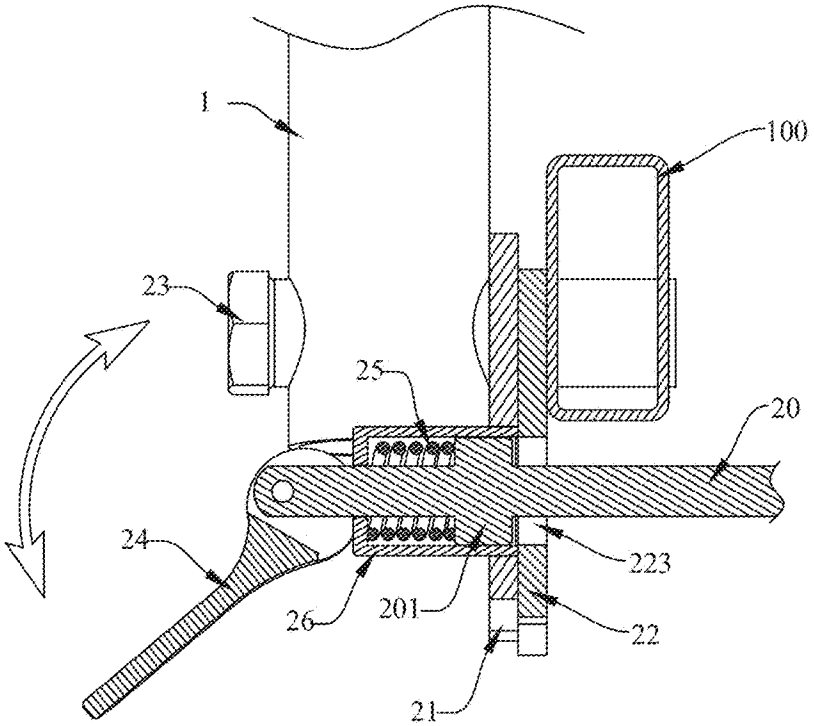

At the side of the armrest handle 1 with the first connecting plate 21, the diameter of the first through hole 212 of the first connecting plate 21 is greater than an outer diameter of the support sleeve 26, such that the support sleeve 26 can pass through the first through hole 212. The end of the support sleeve 26 with the third through hole 261 passes through the first through hole 212 of the first connecting plate 21 and abuts against the rotation control plate 22. The connecting rod 20 successively passes through the limiting hole 223 of the rotation control plate 22, the first through hole 212 of the first connecting plate 21, the first spring 25, and the fourth through hole 263 of the support sleeve 26. The limiting member 201 successively passes through the limiting hole 223 and the first through hole 212 to abut against one end of the first spring 25, and the other end of the first spring 25 abuts against the abutting ring 262 at an inner side of the support sleeve 26. The end of the connecting rod 20, after passing through the support sleeve 26, is fixedly connected to an eccentric cam handle 24. The eccentric cam handle 24 is an eccentric cam operation handle, as shown in FIGS. 5 and 6. As the eccentric cam handle 24 is rotated at different angles, a length of the connecting rod 20 that is pulled outwards can be adjusted, and the limiting member 201 can be moved out of the limiting hole 223, thereby enabling control of rotation-locked and rotation-unlocked states of the armrest handle 1 by the eccentric cam handle 24. The right limiting member 201 on the connecting rod 20 is positioned in the right limiting hole 223 when the eccentric cam handle 24 is rotated to the closed state, and the right limiting member 201 on the connecting rod 20 is moved out of the right limiting hole 223 when the eccentric cam handle 24 is rotated to the open state. In addition, the support sleeve 26 can also abut against the surface of the first connecting plate 21, such that the limiting member 201 can be moved into the support sleeve 26 through the limiting hole 223, the first through hole 212, and the third through hole 261, so as to abut against the first spring 25. The length of the support sleeve 26 or the length of the first spring 25 at this side may be further adjusted, such that the two ends of the connecting rod 20 are moved by the same amount, thereby enabling the limiting members 201 at the two ends of the connecting rod 20 to be synchronously moved out of corresponding limiting holes 223, which will not be described in detail in this embodiment.

When the folding mechanism for an armrest handle is mounted on a treadmill, fourth mounting holes 101 are first disposed separately at symmetrical positions on treadmill frame tubes 100 at two sides of the treadmill. At the left side of the treadmill, a fastener 23 successively passes through the through hole at the left bottom end of the armrest handle 1, the first mounting hole 211 of the first connecting plate 21, the second mounting hole 221 of the rotation control plate 22, and the left fourth mounting hole 101 on the treadmill so as to engage the left lower end of the armrest handle 1, the first connecting plate 21, and the rotation control plate 22 to the left treadmill frame tube 100 of the treadmill. At the right side of the treadmill, a fastener 23 successively passes through the through hole at the right bottom end of the armrest handle 1, the third mounting hole 281 of the second connecting plate 28, the second mounting hole 221 of the rotation control plate 22, and the right fourth mounting hole 101 on the treadmill so as to engage the right bottom end of the armrest handle 1, the second connecting plate 28, and the rotation control plate 22 to the right treadmill frame tube 100 of the treadmill. Then the connecting rod 20 enters the left side of the armrest handle 1, successively passes through the first through hole 212 of the first connecting plate 21 and the limiting hole 223 of the rotation control plate 22, and then successively passes through the limiting hole 223 of the right rotation control plate 22 and the second through hole 282 of the second connecting plate 28, such that the end of the limiting member 201 at the right end of the connecting rod 20 abuts against the second connecting plate 28. Next, the second spring 29, the support sleeve 26, and the limiting cap 27 at the right side of the armrest handle 1 are fixedly connected, and then the first spring 25, the support sleeve 26, and the eccentric cam handle 24 at the left side of the armrest handle 1 are fixedly mounted, thus completing mounting.

Embodiment 2

Figure 7:
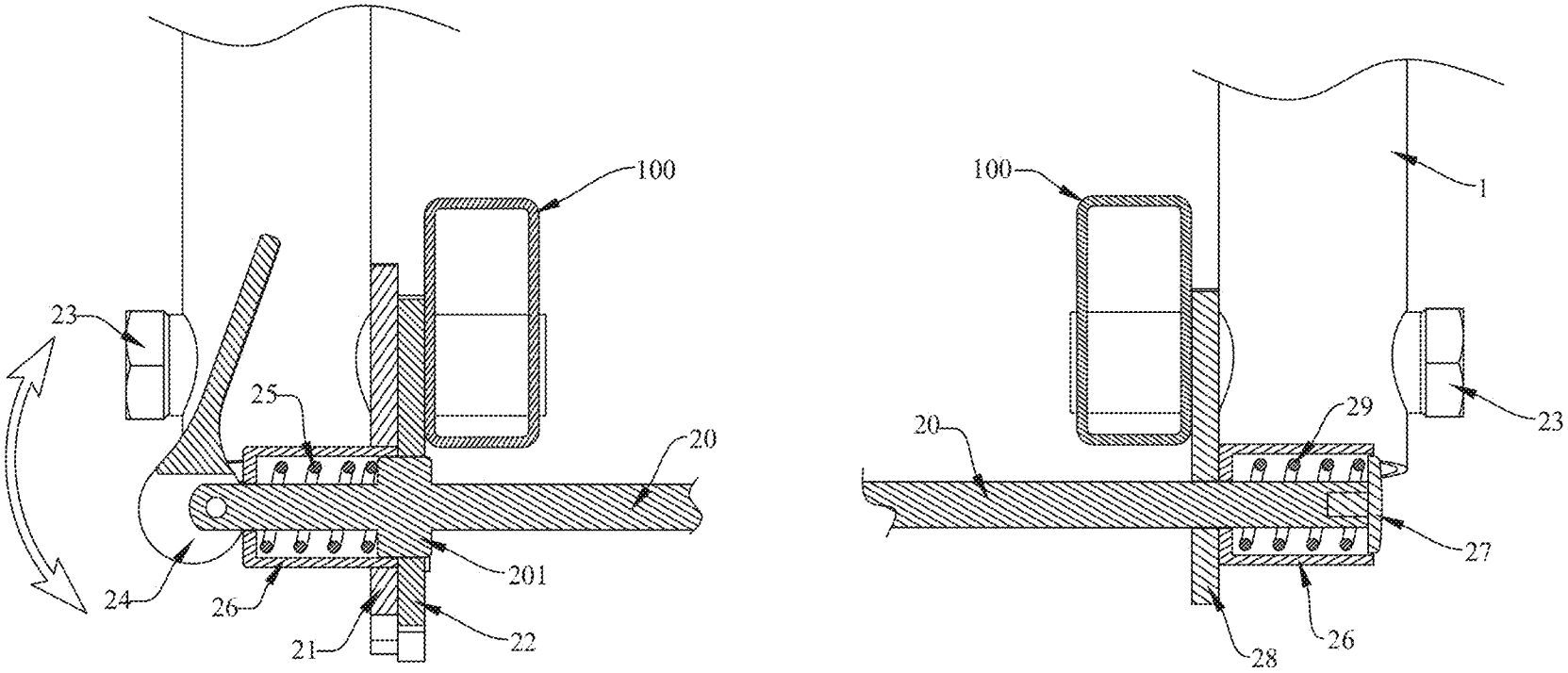
FIG. 7 is a schematic view showing an armrest handle with single-sided locking in use in a locked state in Embodiment 2 of a folding mechanism for an armrest handle.
Figure 8:
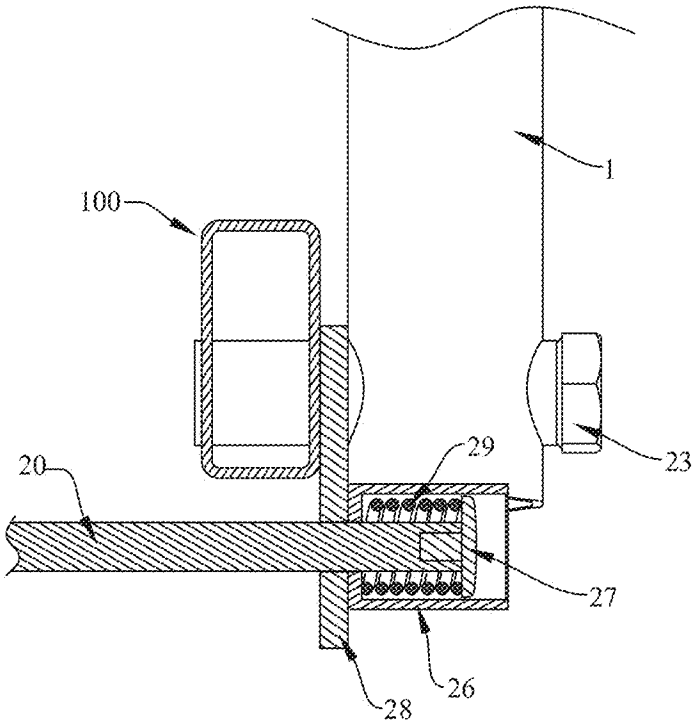
FIG. 8 is a schematic view showing the armrest handle with single-sided locking in use in an unlocked state in Embodiment 2 of a folding mechanism for an armrest handle.
Figure 8:
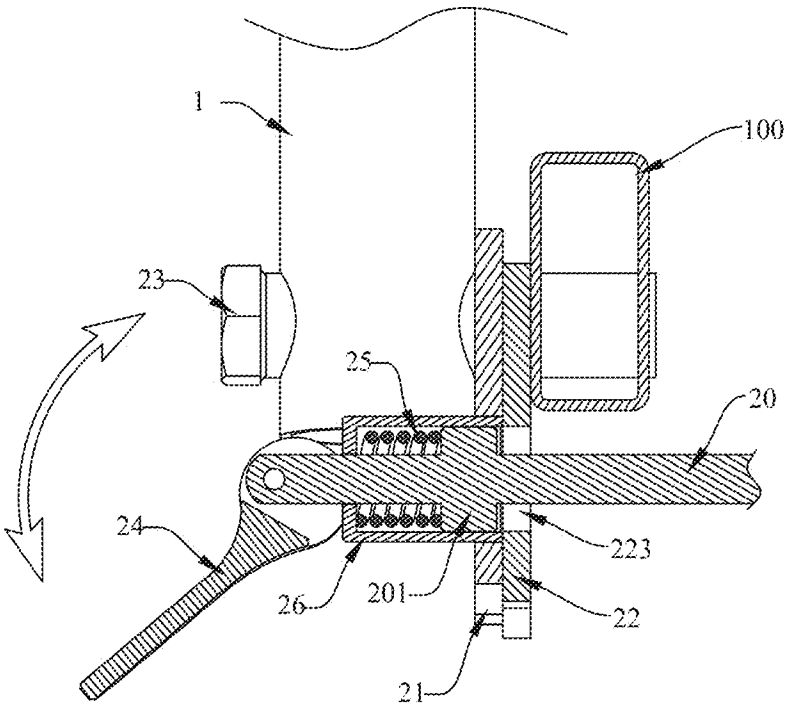

Further, the combination of the rotation control plate 22 with the limiting member 201 may be provided only at one side of the armrest handle, which may also achieve the rotation control of the armrest handle 1. As shown in FIGS. 7 and 8, the connecting rod 20 is provided with a limiting member 201 only on the left side, and a rotation control plate 22 is provided at the left end of the armrest handle 1. Compared with the case where the rotation control plates 22 and the limiting members 201 are provided on two sides, this embodiment requires reduced component parts and material costs, and achieves simplification in mounting.

From the above description, it can be seen that the above embodiments of the present invention achieve the following technical effects.

1. In the folding mechanism for an armrest handle of a treadmill, a sliding groove 222 and a limiting hole 223 are disposed on the rotation control plate 22. The connecting rod 20 is provided with a limiting member 201. When the limiting member 201 is positioned within the limiting hole 223, the connecting rod 20 is controlled to be unable to be moved into the sliding groove 222 such that the connecting rod 20 is controlled to be unable to be rotated relative to the armrest handle 1. When the limiting member 201 is moved out of the limiting hole 223, the connecting rod 20 can be moved into the sliding groove 222 such that the connecting rod 20 can be rotated relative to the armrest handle 1 so as to achieve the control of rotation and folding of the armrest handle 1.
2. By providing a limiting cap 27 at a lateral side of the second connecting plate 28 and providing a support sleeve 26 and an eccentric cam handle 24 at a lateral side of the first connecting plate 21, the connecting rod 20 is connected to left and right ends of the armrest handle 1 with a limited movement in a left-right direction.
3. A spring is provided in the support sleeve 26 to facilitate restoration after a change of the rotation state.
4. Limiting members 201 are provided on two sides of the connecting rod 20 and cooperate with corresponding rotation control plates 22, separately, so as to improve the stability of the armrest handle 1 as locked.

Compared with the prior art, the folding mechanism for an armrest handle of a treadmill of the present invention enables the armrest handle to be folded through an operation at one side of the treadmill, so as to achieve an easy operation, a simple structure, and convenience in mounting.

The foregoing shows merely exemplary embodiments of the present invention and is not intended to limit the present invention. Various modifications and variations may be made to the present invention by those skilled in the art. Any modification, equivalent replacement, improvement, and the like made within the spirit and principle of the present invention shall be included in the scope of protection of the present invention.

The invention claimed is:

1. A folding mechanism for an armrest handle of a treadmill, comprising:

the armrest handle having left and right bottom ends that are configured to be connected to the treadmill;

a rotational assembly, comprising:

a connecting rod, a limiting member being provided on a left section of the connecting rod, and a diameter of the limiting member being greater than a diameter of the connecting rod;

a first connecting plate, a first through hole being disposed on the first connecting plate, and a diameter of the first through hole being greater than the diameter of the limiting member;

a second connecting plate, a second through hole being disposed on the second connecting plate, and a diameter of the second through hole being greater than the diameter of the connecting rod; and a rotation control plate, a sliding groove being arc-shaped and disposed on the rotation control plate, one end of the sliding groove being provided with a limiting hole that is in communication with the sliding groove, a width of the sliding groove being greater than a width of the connecting rod and less than a width of the limiting member, and a diameter of the limiting hole being greater than the diameter of the limiting member;

wherein: the first connecting plate and the second connecting plate being fixedly connected to medial sides of the left and right bottom ends, separately, of the armrest handle opposite each other; the rotation control plate being fixedly mounted at one side of the first connecting plate, and the limiting hole being mounted opposite to the first through hole; left and right ends of the connecting rod being connected to the left and right bottom ends of the armrest handle, respectively, through the first connecting plate and the second connecting plate; the connecting rod being not capable of sliding along the sliding groove in a case that the limiting member is positioned in the limiting hole, and the connecting rod being capable of sliding along the sliding groove in a case that the limiting member is moved left and out of the limiting hole.

2. The folding mechanism for the armrest handle of the treadmill according to claim 1, wherein:

a limiting cap is provided at a lateral side of the second connecting plate, the right end of the connecting rod is fixedly connected to the limiting cap after passing through the second through hole, and a diameter of the limiting cap is greater than the diameter of the second through hole;

a support sleeve is provided at a lateral side of the first connecting plate, a third through hole is disposed at one end of the support sleeve, a diameter of the third through hole is greater than the diameter of the limiting member, an abutting ring is provided at another end of the support sleeve, a fourth through hole, which is in communication with the third through hole, is disposed at a center of the abutting ring, and a diameter of the fourth through hole is greater than the diameter of the connecting rod and less than the diameter of the limiting member; a left end of the connecting rod successively passes through the fourth through hole and the third through hole to be engaged to an eccentric cam handle; the limiting member is positioned in the limiting hole in a case that the eccentric cam handle is rotated to a closed state, and the limiting member is moved out of the limiting hole in a case that the eccentric cam handle is rotated to an open state.

3. The folding mechanism for the armrest handle of the treadmill according to claim 2, wherein:

a first spring is provided inside the support sleeve, with one end of the first spring abutting against an inner wall of the abutting ring, and the other end of the first spring abutting against the limiting member.

4. The folding mechanism for the armrest handle of the treadmill according to claim 3, wherein:

a second support sleeve is further provided at the lateral side of the second connecting plate, the diameter of the limiting cap is less than the diameter of the third through hole, and a second spring is provided inside the second support sleeve, with one end of the second spring abutting against an inner wall of a second abutting ring, and another end of the second spring abutting against the limiting cap.

5. The folding mechanism for the armrest handle of the treadmill according to claim 2, wherein:

a second rotation control plate is further fixedly mounted at a medial side of the second connecting plate, and a second limiting hole is mounted opposite to the second through hole; a second limiting member is further provided on a right section of the connecting rod; the second limiting member on the connecting rod is positioned in the second limiting hole in the case that the eccentric cam handle is rotated to the closed state, and the second limiting member on the connecting rod is moved out of the second limiting hole in the case that the eccentric cam handle is rotated to the open state.

6. The folding mechanism for the armrest handle of the treadmill according to claim 5, wherein:

a first mounting hole is disposed on the first connecting plate, a second mounting hole is disposed on the rotation control plate, and a fastener successively passes through the left bottom end of the armrest handle, the first mounting hole, and the second mounting hole so as to fixedly connect the first connecting plate and the rotation control plate to a left end of the armrest handle.

7. The folding mechanism for the armrest handle of the treadmill according to claim 6, wherein:

a third mounting hole is disposed on the second connecting plate, a second mounting hole is disposed on the second rotation control plate, and a second fastener successively passes through the third mounting hole, the second mounting hole, and the right bottom end of the armrest handle so as to fixedly connect the second connecting plate and the second rotation control plate to a right end of the armrest handle.

* * * * *